US006550656B2

(12) United States Patent
Kurz

(10) Patent No.: US 6,550,656 B2
(45) Date of Patent: Apr. 22, 2003

(54) DEVICE FOR SPREADING, COMPRESSING AND GUIDING A RUNNING MATERIAL WEB

(75) Inventor: Hans-Joachim Kurz, Grossaitingen (DE)

(73) Assignee: Erhardt + Leimer GmbH, Augsburg (DE)

( * ) Notice: Subject to any disclaimer, the term of this patent is extended or adjusted under 35 U.S.C. 154(b) by 125 days.

(21) Appl. No.: 09/815,502

(22) Filed: Mar. 23, 2001

(65) Prior Publication Data

US 2001/0023883 A1 Sep. 27, 2001

(30) Foreign Application Priority Data

Mar. 25, 2000 (DE) ..... 100 15 055

(51) Int. Cl.[7] ..... B65H 26/00; D06H 3/08

(52) U.S. Cl. ..... 226/19; 26/51.5; 26/100; 226/96

(58) Field of Search ..... 226/19, 20, 96, 226/179; 26/51.5, 100

(56) References Cited

U.S. PATENT DOCUMENTS

| | | | | | |
|---|---|---|---|---|---|
| 307,448 | A | * | 11/1884 | Drown | 26/100 |
| 2,332,104 | A | * | 10/1943 | Meyer | 226/20 |
| 2,752,151 | A | * | 6/1956 | Levine | 226/20 |
| 3,052,395 | A | * | 9/1962 | Scott | 226/19 |
| 3,637,122 | A | * | 1/1972 | Tokunaga | 226/19 |
| 3,784,076 | A | * | 1/1974 | Avery et al. | 226/19 |
| 4,545,516 | A | * | 10/1985 | Miyai | 226/20 |
| 5,246,099 | A | * | 9/1993 | Genovese | 226/19 |

FOREIGN PATENT DOCUMENTS

| | | | | |
|---|---|---|---|---|
| DE | 34 30 218 | | 2/1985 | |
| DE | 42 13 208 | | 2/1993 | |
| JP | 3-95059 | * | 4/1991 | 226/19 |

* cited by examiner

*Primary Examiner*—Michael R. Mansen
(74) *Attorney, Agent, or Firm*—Collard & Roe P.C.

(57) ABSTRACT

A device for spreading, compressing or guiding a running material web formed by a rotatably supported roll. The roll has a number of slats distributed over its circumference which can be displaced transversely to the direction of the web. The slats are actively connected with control devices that cause a longitudinal displacement of the slats. Alternating slats are actively connected to different control devices. Half of the slats have an adhesive surface and the other half has a sliding surface.

7 Claims, 2 Drawing Sheets

DEVICE FOR SPREADING, COMPRESSING AND GUIDING A RUNNING MATERIAL WEB

BACKGROUND OF THE INVENTION

1. Field of the Invention

The invention relates to a device for spreading, compressing and guiding a running web of material.

2. The Prior Art

A device for guiding and spreading a running web of material is known from German Patent Application No. 42 13 208 C2. This device is formed by a roll that has a series of slats distributed over the circumference of the roll. These slats extend transversely in the direction in which the web is running, and parallel to the axis of the roll. The slats each extend from one end of the roll up to a center area. Within the area of the outer ends of the roll, control disks are provided and are connected to an end of each slat at the respective end of the roll via guide rods. These control disks can be swivelled by servo-drives that operate independently of the rotation of the roll. Therefore, the slats have a pushing movement in the longitudinal direction as the roll is completing one full rotation. This pushing movement displaces the material web sideways, with the material web being pulled over the slats.

By positioning both control disks at an acute angle in relation to one another, the displacement of the slats of both roll end areas is away from each other, so that the web of material is spread or compressed. However, openings are produced in this process in the center area between the aligned slats. These openings open and close in the course of one rotation of the roll. The openings pose a substantial risk of accidents especially while a new web of material is being threaded in because the operator's finger may easily get caught in the openings. However, if the web of material is guided by belts, such belts may penetrate the openings and get into the space beneath a center slat end, causing the slat to be destroyed in the course of a rotation of the roll. This results in a loss of production and repair costs.

A guide device for a traveling web of material is also known from German Patent Application No. 34 30 218 C2. This guide device is formed by a roll and the longitudinally displaceable slats are disposed on the outer circumference of the roll. These slats are transversely displaced by a controlling device located on one side in the direction of travel of the material web. The slats extend over the entire width of the material web. This device is exclusively suited for guiding the material web without spreading or compressing it.

SUMMARY OF THE INVENTION

It is an object of the present invention to provide a device for spreading, compressing and guiding a running material web that is safer to operate and reduces the risk of accidents.

The device of the present invention is employed both for guiding and spreading or compressing a running web of material. The device comprises a rotating roll which is looped by the material web preferably at an angle between 90° and 180°. On the roll, slats are provided that are distributed over the circumference of the roll and transversely extend in the direction of web travel. These slats are longitudinally displaceable on the roll and the displacement of the slats is accomplished by control devices. The running web of material is guided along by the slats and the slats are transversely displaced in the running direction of the web, and the web is displaced corresponding to the movement of the slats. A web running outside its nominal position can be returned to its correct position with great precision. Furthermore, to allow spreading of the material web, half of the slats have a higher adhesive power than the opposite half. Therefore, a slat can pull one half of the web, so that a spreading effect can be achieved in addition to the desired guiding effect. Owing to the difference in adhesive power of the two halves of the slats, the slats can extend transversely over the entire width of the web of material so that no division of the slats is required within the center area of the roll. Furthermore, since there is no division of the slats, no variable openings will occur between the slats. Furthermore, no belts can get caught or entangled between the slats, so that any destruction of slats is avoided.

The difference in adhesive power of the halves is preferably as high as possible to achieve good response of the halves of the material web to the movement of the slats. Finally, the advantage of the present invention is that the slats extending over the material web are substantially more stable than slats that are self-supporting at one end. Therefore, the slats are capable of supporting higher web pulling forces overall. The slats are also simply manufactured and with greater material savings. Due to the through-extending support of the material web over its entire width, the web is guided across the slats in a smooth manner without folds or waves. Furthermore, there is no risk that the ends of the slats may damage the underside of the material web in any way. To guide and spread the material web with the roll at the same time, it is necessary to control some of slats with one of the control devices and the remaining slats with another control device. Therefore, all jointly controlled slats are provided with the adhesive side located in the same slat area. This assures that the slats controlled by one control device engage only one of the two web halves in an adhesive manner, whereby the half of the web disposed on the opposite side is practically not influenced by the slats. Therefore, each control device can determine the run of the respective edge of the web substantially independent of the other control device. By moving the control devices in the same direction, it is possible to influence the guidance of the material web, and by moving the control devices in opposing directions, a spreading effect of the material web will occur.

To achieve the greatest possible response of the material web to the movement of the slats, it is preferred that half of each slat is coated with an adhesive. This adhesive surface provides for optimal transmission of the movement of the slats to the web of material, so that the movement of the material web along the slats substantially corresponds to the actual course of the respective edge of the web. However, the engagement area on the opposite side of the web is provided with a surface that has a sliding property along the material web. Therefore, the area of the oppositely disposed edge of the web is not influenced by the slats, which is particularly important when the material web is spread. For spreading, the two halves of the material web are pulled in opposite directions. However, each slat would basically pull both halves of the material web in the same direction. The surface of the slat is therefore provided with a sliding property on part of its surface area, so that the slat exert no force on the material web.

For simpler manufacturing of the slats, it is advantageous if the slats are provided with an adhesive coating. This coating may be arranged in a suitable recess of the slat, so that it will not substantially protrude beyond the surface of the slat. Alternatively, the adhesive coating can also be applied directly to the surface of the slats such that the adhesive coating remains adequately thin. The extra thickness formed on the surface of the slats can be used for engaging the material web in the area of the adhesive coating.

The adhesive coating preferably has a napped-like structure to achieve optimal adhesion of the material web to the adhesive coating.

In the event a wet web of material has to be guided or spread, it is advantageous if the adhesive coating is provided with channels for draining the liquid. The liquid contained in the material web is pressed into the adhesive coating by a tension force applied to the material web where it can drain via the drain channels. Draining the liquid provides improved adhesion of the web to the slat.

It is preferred that alternating slats are associated with the same control device. Therefore, an adhesive slat is followed by a sliding slat. This results in a control system for running and spreading the web that responds in a highly sensitive manner. In particular, it has been found that the guiding effect of the slats is enhanced if a sliding slat is provided between each two adhesive slats along one side of the web. This occurs because within the area of the sliding slat, the web is capable of compensating the differences in travel distance of the adhesive slats moving at different speeds by a relatively minor shear. On the other hand, if adhesive slats were to successively follow each other in direct sequence, a high shearing effect would be created on the material web. This shearing effect would cause folds in the web. However, the web generally slides to a minor degree across the adhesive coating to eliminate the shearing forces. This, however, reduces the guiding effect of the slats, which is avoided by the arrangement of the slats in the present invention.

To control the movement of the slats in the easiest and most precise manner, the control devices are formed by control disks which are connected with the slats via guide rods. The control disks are preferably pivot-mounted, rotating about an axis extending perpendicular to the axis of the roll. The control devices are not coupled to the rotational motion of the roll, but are stationary. Therefore, the slats connected with the control disks via the guide rods move away from the center of the roll during the first half of a rotation of the roll, and toward the center of the roll during the next half of the rotation of the roll. The material web loops around the roll only on a partial area, in which the slats move away from the center of the roll during the rotation of the roll. This results in a continual spreading, whereby the spreading effect can be adjusted in any desired manner by the angular position of the control disks.

To control the run of the material web, the control disks are controlled by a controlling device. Therefore, the control disks are pivoted at angular positions in relation to the axis of rotation of the roll by servo-drives. A controlling device influences the run of the web via the servo-drive and the angular position of the control disk and the movement of the slats.

To assure precise movement of the slats, the slats are supported in slide guides. These slide guides are useful in the area of the free ends of the slats to ensure that the material web is adequately supported on the slats over its entire width. The slide guides are kept stationary on the roll. This provides for undercut slide guides that prevent the slats from tilting away from the axis of the roll.

If the control devices each are controlled by a servo-drive, the spreading and guiding effects can be adjusted independently of each other and without manual intervention. It is also possible to control the positions of both edges of the web for achieving web guidance and control of the width of the web.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
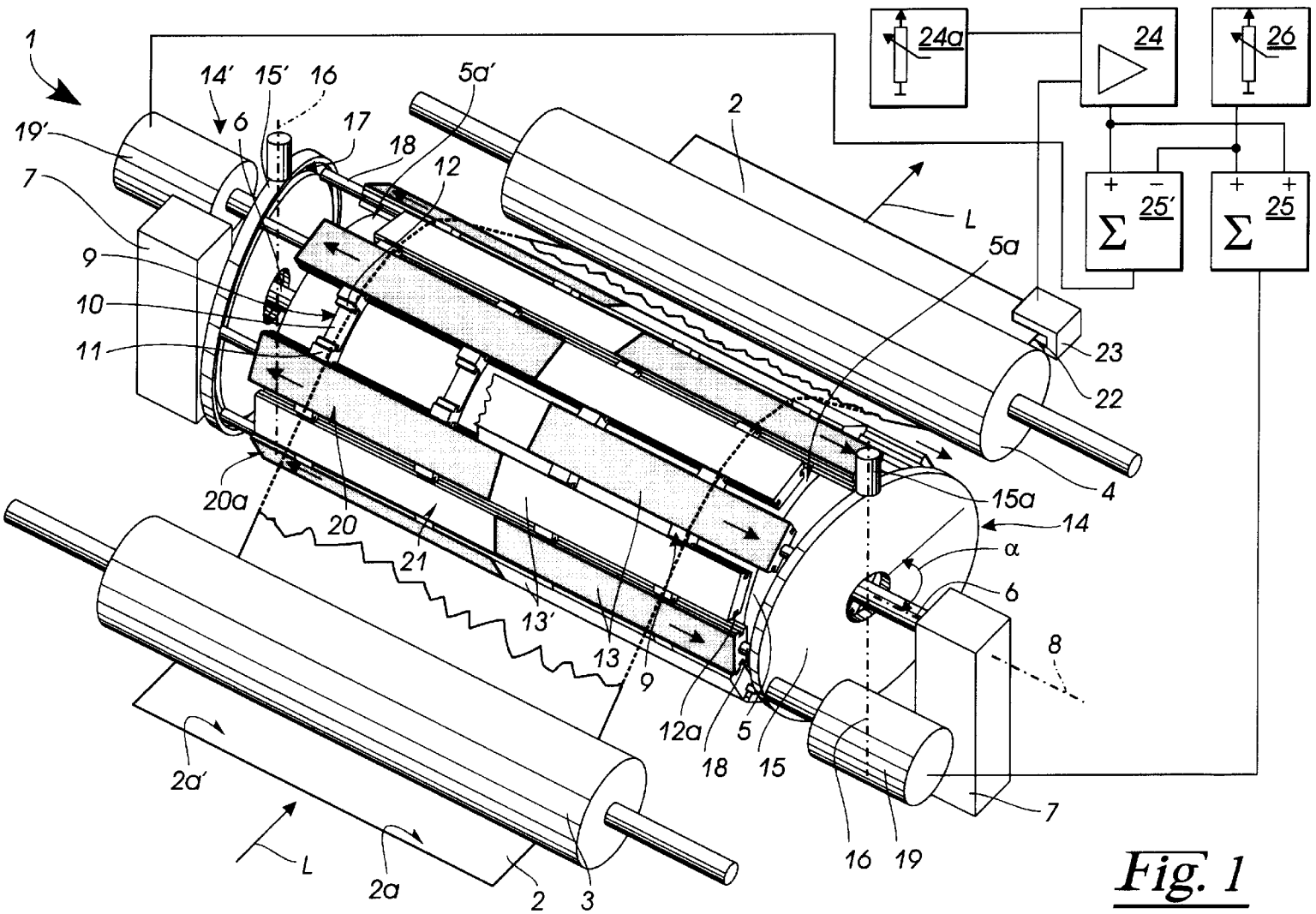
FIG. 1 shows a perspective view of the device for guiding and spreading a running web of material according to the present invention.

Referring now in detail to the drawings and, in particular, FIG. 1 shows a device 1 for guiding and spreading or compressing a material web 2 in the direction "L". Fixing rolls 3, 4 are arranged upstream and, respectively, downstream of the device 1 and the material web 2 is reversed on fixing rolls 3, 4. Fixing rolls 3, 4 maintain the material web 2 upstream and, respectively downstream of the device 1 in a defined manner, which is required for the exact guidance or spreading of the material web 2.

Device 1 comprises a roll 5, which is supported on a through-extending shaft 6 and which has two halves 5*a*, 5*a*'. Shaft 6 is supported in pivot bearings 7 and freely rotates about a roll axis 8. In another embodiment, roll 5 can be driven with a motor to compensate the resistance exerted by material web 2 on roll 5.

Slide guides 9 are arranged on roll 5 and extend over the length of roll 5. Slide guides 9 consist of a ring 10, which corresponds to the circumference of the roll on the inner side, and bridges 11 are arranged on slide guides 9 and uniformly distributed over its outer circumference. Bridges 11 have springs 12, which engage grooves 12*a* of slats 13, 13'. Slats 13, 13' are longitudinally displaceable spacing between the slats as well as the spacing of slats 13, 13' from roll axis 8 remains constant.

Slats 13, 13' are actively connected with control devices 14, 14' provided at the two ends of the roll. Control devices 14, 14' each are formed by a disk 15, 15', swiveling in a pivot bearing 15*a* around a swivel axis 16. A guide groove 17 is provided at the outer circumference of disk 15, 15*a*. Guide rods 18 are supported in guide groove 12*a* via sliding blocks (not shown). At their counter ends, guide rods 18 are connected with a part of slats 13, 13', whereby every second slat 13 is actively connected with control device 14, and the remaining slats 13' are actively connected with control device 14'.

If disk 15 is set at an acute angle "$\alpha$" in relation to roll axis 8 as shown in FIG. 1, slats 13 are displaced during their rotation to the right in the area of the upper half of stationary disk 15, and to the left in the lower half of disk 15. Two disks 15, 15' are actively connected with servo-drives 19, 19', via which the angles of swivel "$\alpha$" of disks 15, 15*a* are set. In the right half, slats 13 are provided with a coating 20 to which material web 2 can easily adhere. The left half of slats 13 is provided with a sliding surface 21. Slats 13' actively connected with control device 14' are identical to slats 13 actively connected with control device 14, whereby adhesive coating 20 is applied to the left half of slats 13'.

On one half (20*a*), slats 13 are provided with a coating 20 to which the material web 2 can readily adhere. On the other hand, the left half of the slats 13 is provided with a sliding surface. The slats 13' actively connected with the control device 14' are substantially identical with the slats 13 actively connected with the control device 14, whereby the adhesive coating 20 is applied to the left half of the slats 13'.

Due to the preset position of fixing rolls 3, 4, material web 2 loops around roll 5 having two halves 5*a* and 5*a*' in the upper area by about 90°. In this area, slats 13 are displaced to the right during the rotation of roll 5 because of the inclined position of disk 15, and slats 13' are displaced to the left. Since material web 2 adheres to slat 13 only with its right half 2*a* of the web, and to slat 13' only with its left half 2*a*' of the web, the material web is spread because slats 13 and 13' are moving in opposite directions. If the setting angle "α" of disk 15 is greater than the angle of disk 15', slats 13 pull stronger to the right than slats 13' pulling to the left. Material web 2 is then shifted to the right, so that, in addition to the spreading effect, the device also exerts a guiding effect on material web 2.

To achieve control of the run of the web, web edge 22 is scanned by a sensor 23 and the scanned value is compared in a controlling system 24 having a nominal value 24*a*. On the output side, controlling system 24 is actively connected to two adders 25, 25', which add or subtract the control signal with an offset 26. Offset 26 determines the setting of disks 15, 15' in opposite directions and thus the spreading effect to be achieved by device 1. On the output side, adders 25 are actively connected to two servo-drives 19, 19', so that a closed control circuit is obtained.

Figure 2:
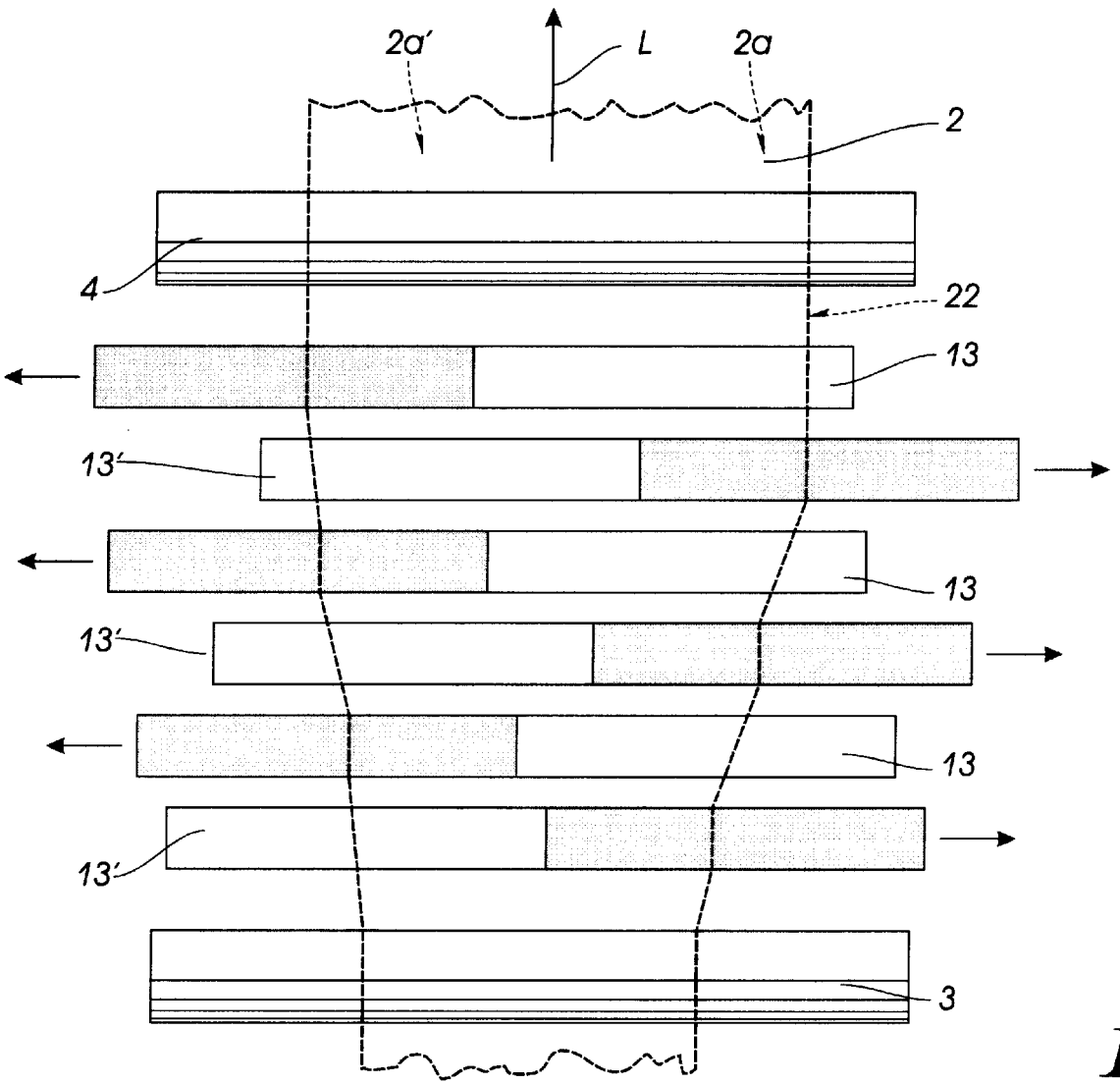
FIG. 2 is a schematic representation of the device of FIG. 1.

The mode of operation of the device 1 is explained in greater detail with the help of the schematic representation shown in FIG. 2. Material web 2 loops around two fixing rolls 3, 4, so that the two rolls form fixing points for material web 2. Slats 13 are provided with adhesive coating 20 on the right side, and slats 13' on the left side. As roll 5 is rotating, the slats 13 are shifted to the right, and slats 13' to the left. The distance of displacement of slats 13 increases during this shifting process in the direction "L" in which the web is running, so that web 2 is distorted between two slats 13 in the form of a parallelogram. This distortion increases as the angle "α" of disk 15 decreases.

Slat 13' is positioned between two slats 13. However, slat 13' has sliding surface 21 within the area of the right half 2*a* of the web. Sliding surface 21, however, has no bearing on the run of the web, so that material web 2 has adequate space between slats 13 to adapt itself to the different movements of slats 13. The parallelogram-like distortion of material web 2 is minor resulting in advantageous guiding by the device 1.

In left web half 2*a*' of material web 2, slats 13' with their left-oriented movement provide for a corresponding tensile force of the left material web edge 22. This results overall in a good guiding and spreading effect exerted on material web 2.

Accordingly, while only a few embodiments of the present invention have been shown and described, it is obvious that many changes and modifications may be made thereunto without departing from the spirit and scope of the invention.

What is claimed is:

1. A device for spreading, compressing and guiding a running material web comprising:

a rotatable roll (5);

a series of slats (13, 13') disposed around the circumference of the roll (5), said slats extending transverse to a moving direction (L) of the material web, wherein each slat comprises a first half and a second half, said first half of every other slat at least partially having a greater adhesive power than the corresponding second half, said corresponding second half being provided with a sliding surface, and said second half of the remaining slats having a greater adhesive power than the corresponding first half of the remaining slats, said corresponding first half of the remaining slats being provided with a sliding surface, so that the material web, when viewed in the moving direction of the web, is engaged by successive slat halves in an alternating adhesive and sliding manner; and a control device (14, 14') disposed at each end of the roll (5) for periodically displacing the slats (13, 13') transversely to the material web during rotation of the roll (5).

2. The device according to claim 1, wherein the slats having the greater adhesive power are coated with an adhesive coating (20).

3. The device according to claim 1, wherein every other slat (13, 13') is associated with the same control device (14, 14').

4. The device according to claim 1, wherein the control devices (14, 14') comprise control disks (15, 15') and guide rods (18) being distributed around a circumference of said disks, for engaging said control disks, said guide rods being actively connected with the slats (13, 13').

5. The device according to claim 4, wherein said control disks (15, 15') are pivotable in their angular positions with respect to the axis of rotation (8) of the roll (5).

6. The device according to claim 1, further comprising slide guides (9) for supporting the slats (13, 13'), said slide guides (9) being axially aligned with the roll (5), and stationarily supported on the rotatable roll (5).

7. The device according to claim 1, wherein the control devices (14, 14') each are actively connected with a servo-drive (19, 19').

* * * * *